US006087576A

United States Patent [19]

Masubuchi

[11] Patent Number: 6,087,576

[45] Date of Patent: Jul. 11, 2000

[54] ELECTRONIC MUSICAL KEYBOARD APPARATUS RESISTANT TO YAWING FORCES AND ROLLING FORCES

[75] Inventor: Takamichi Masubuchi, Hamamatsu, Japan

[73] Assignee: Yamaha Corporation, Hamamatsu, Japan

[21] Appl. No.: 09/026,741

[22] Filed: Feb. 20, 1998

[30] Foreign Application Priority Data

| | | | |
|---|---|---|---|
| Feb. 24, 1997 | [JP] | Japan | 9-039478 |
| Feb. 24, 1997 | [JP] | Japan | 9-039481 |
| Feb. 24, 1997 | [JP] | Japan | 9-039482 |

[51] Int. Cl.[7] ..... G10C 3/12

[52] U.S. Cl. ..... 84/433

[58] Field of Search ..... 84/423 R, 433, 84/435, 434, 424, 441, 430, 432, 438, 745, 744, 719, 720

[56] References Cited

U.S. PATENT DOCUMENTS

| | | | |
|---|---|---|---|
| 3,205,754 | 9/1965 | Becwar | 84/433 |
| 3,570,359 | 3/1971 | Ohno | 84/423 |
| 3,855,894 | 12/1974 | Thomas et al. | 84/423 |
| 4,488,472 | 12/1984 | Kumano et al. | 84/434 |
| 5,821,443 | 10/1998 | Masubushi | 84/433 |

FOREIGN PATENT DOCUMENTS

| | | |
|---|---|---|
| 54-5713 | 1/1979 | Japan . |
| 3-174192 | 7/1991 | Japan . |
| 5-181456 | 7/1993 | Japan . |
| 6-175648 | 6/1994 | Japan . |
| 6-342281 | 12/1994 | Japan . |
| 07092963 | 4/1995 | Japan . |
| 7-92963 | 4/1995 | Japan . |

OTHER PUBLICATIONS

Mason, M.H.; Piano Parts and Their Functions., Western Publisher's Service, Seattle, 1977, pp. 26–27.

*Primary Examiner*—Robert E. Nappi
*Assistant Examiner*—Kim Lockett
*Attorney, Agent, or Firm*—Graham & James LLP

[57] ABSTRACT

The keyboard apparatus is constituted by a series of units in which key stems are connected to a key support section through a connection section. The width of the connection section is wider than a width of the back-end of the key stem attached to the connection section, and the units are stacked vertically so that the connection sections partially over lap. White keys are arranged in a plurality of upper key units and lower key units, having key stems, connection sections and support sections, which are transversely linked to one another. In a keyboard in which the lower key units are stacked in such a way that the key support section of the lower key units are underneath the key support sections of the upper key units, the back-ends of the key stems are joined to the transverse midpoints of connection sections. The keys are arranged so that the lateral surfaces of the key stems in adjacent upper key units are disposed substantially in one common plane.

13 Claims, 10 Drawing Sheets

ELECTRONIC MUSICAL KEYBOARD APPARATUS RESISTANT TO YAWING FORCES AND ROLLING FORCES

BACKGROUND OF THE INVENTION

1. Field of the Invention

The present invention relates to a keyboard apparatus for electronic musical instruments such as electronic organ, electronic piano and synthesizer.

2. Description of the Related

Keyboards for use in above types of electronic musical instruments include a comb-teeth type disclosed in a Japanese Patent Application, First Publication, H6-342281. This will be explained briefly with reference to FIG. 13. In this type of keyboard, a white key unit 1 is comprised by resin molding all of the following components into one unit, i.e., a plurality of key stems 2 for depression; a key support section 3 extending in the widthwise direction of the key stem 2 (i.e., transverse to the longitudinal key stems) for supporting the white key stems 2; and flexible connection sections (pivot section) 4, having the same width as the back-end width of the key stem 2, to enable each key stem to vertically swing freely about the pivot point, as shown by an arrow A in the perspective drawing.

Other white key units 1' and black key units 1" are similarly constructed, and the key support section 3 of the white key unit 1 is stacked on top of the other key support section 3' of the black key units 1' while the key support section 3" of the black key unit 1" is stacked on top of the key support section 3. These units are then firmly attached to a base section of a keyboard frame (not shown) using fasteners such as screws.

This type of keyboard apparatus is low cost, however, the lengths of the key units in some of these low cost keyboards are shorter than those in the standard keyboard. In such keyboards, because the key units are shorter, they are sufficiently restricted (stiff) against yawing of the connection section, i.e., a swing movement in the horizontal direction (shown by an arrow B in FIG. 13). Therefore, in some cases key guides to restrict the horizontal swing movement of the key unit are not provided.

However, the keyboards are generally made so that the key units are free to swing vertically in the A direction, but some resisting force is necessary to be provided in the connection section 4 to limit yawing of the key stems 2 in the B direction. Otherwise, when playing glissandos, there is a danger of the adjacent keys touching, and to avoid this phenomenon, key guides have been provided at the free-end of the key stems 2 to prevent the swaying movement of the key stems 2.

Nevertheless, the key guides are a factor in increasing the production cost. Also, the key guides must be greased to prevent noise generation by sliding action against the key units, but greasing is a problematic operation, and furthermore, if the grease is dried up, noise would be generated.

Further, smooth key depression can be hindered by intrusion of foreign particles in the spaces between the key guides and the guide sections of the guided keys.

A solution to the above-mentioned problem in the comb-teeth type keyboards has been disclosed in a Japanese Patent Application, First Publication, H7-92963.

In this keyboard, as shown in FIG. 14, the overall width dimension W of the connection section 4, connecting the key stems 2 in each key unit 1 to the key support sections 3, is wider than the width dimension "a" at the back-end of the key stem 2. When the support sections 3 of a plurality of the white and black key units are assembled to produce a keyboard apparatus, parts of the connection section 4 are stacked on top of those in the adjacent key stem (provided on the other key unit) with a small intervening space.

By making the overall width W of the connection section 4 wider than width "a" of the back-end of the key stem 2, the second moment of area of the connection section 4 in the transverse direction is increased so that horizontal swing (yawing) of the key stem 2 can be restricted without using key guides, thereby permitting production of low cost keyboard that can meet general performance expectations.

However, because such keyboards are made by stacking a number of key support sections of the key units, the vertical dimension d, shown in FIG. 15, between the upper surface of the key stem 2 and the connection section 4, is different for each key unit. In other words, because the connection section 4 of each key unit is partially stacked on top of each other, a key unit whose connection section 4 is placed below that of another key unit must have a larger vertical dimension d corresponding to the stacked thickness of the connection sections 4. The result is that even for two white key units, the dimension of d is larger for the lower key unit compared with the upper key unit.

If an elastic yawing factor is expressed as a ratio of (magnitude of the yawing force)/(displacement by yawing in the horizontal swing direction), a given force will generate a lesser degree of yawing in a section having a high yawing factor than in a section having a low yawing factor. Also, the smaller the dimension d, the larger the yawing factor of a key unit.

If it is assumed that the key unit shown in FIG. 14 is an upper key unit, the elastic yawing factor for the C-key whose back-end of the key stem 2 is connected to the transverse edge of the connection section 4 is about 140 gf/mm (gram force/mm), and the elastic yawing factor for the E-key whose back-end of the key stem 2 is connected to a transverse midpoint of the connection sections is about 170 gf/mm.

The reason for causing such differences in the elastic yawing factor is that the strain in the connection section 4 caused by yawing shows a different distribution, as shown by the curve in FIG. 14, depending on the joining location of the back-end of the key stem 2 to the connection section 4.

On the other hand, for the lower key units, the elastic yawing factor for a key which is connected to a transverse midpoint of the connection section 4, as in the E-key, is about 140 gf/mm.

Therefore, even for those keys having the same connection structure, the lower key unit has a lower elastic yawing factor compared with the upper key units. This is brought about by the difference in the dimension (distance) d between the upper surface of the key stem 2 and the connection section 4, shown in FIG. 15. That is, the elastic yawing factor is higher for a key having the connection section 4 extending nearer to the upper surface of the key stem 2 (i.e., d is smaller).

From these results, it can be understood that the elastic yawing factor drops under the following two conditions:

(1) when the back lateral surface of the key stem 2 almost coincides with the lateral surface of the connection section 4, as shown by the C-key in FIG. 14; and (2) when the key stems are connected to the key support section in the lower unit.

When these two conditions exist together, for example, when the C-key in FIG. 14 is in the lower unit (size d in FIG. 15 is larger than that in the upper unit), the elastic yawing factor drops to about 110 gf/mm. The result is that the spread in the elastic yawing factors for the keys in the upper key unit is about 140–170 gf/mm, but the overall spread in the elastic yawing factors for all the keys, including the upper and lower units, becomes 110–170 gf/mm.

As explained above, when there is a large spread in the elastic yawing factors of the keys constituting the keyboard, the player feels inconsistency in the key-touch sense to properly express artistic expressions. Also, such an arrangement is not desirable because of the possibility of adjacent keys touching during the performance.

It is, therefore, an object of the present invention to provide a keyboard apparatus having a small degree of spread in the elastic yawing factors between the upper and lower key units for the white keys, to provide an improved sense of key-touch by increasing the yawing strength of all the keys, and furthermore to prevent the yawing motion to cause the adjacent keys to touch each other during playing.

It is another object to provide a keyboard having key spacings between the adjacent keys that can be adjusted readily, especially the spacing between the highest- note-key and the adjacent key, and that can be produced with a fewer metal molds to reduce the capital cost.

It is still another object to provide a keyboard having a plurality of keys that allows easy depression of the keys while retaining moldability of the connection section and preventing the yawing movement of the keys.

There is another problem in the currently available keyboard such that, when the key support sections of the various key units are stacked and fastened to each together, a large frictional force is generated between the beveled surface of the screw head and the key support section to leave twisting strains in the screw direction in the key support sections.

Because the present keyboard does not have key guides, twisting strain in the key support section is reflected directly in the non-uniformity in the key spacings. This is highly undesirable for a high quality appearance. In particular, non-uniformity in the white key spacing becomes far more apparent at their front ends, because of a greater longitudinal length of the white keys compared with the black keys.

Therefore, it is still another object of the present invention to provide a keyboard apparatus that does not present such a problem.

There is a further problem in the type of keyboard apparatus having a wide and multiple-stacked connection sections between the key stems and the key support section to eliminate the key guides. As shown in FIG. 16, the distances db, dw formed, respectively, between the upper surface of the black key stems 2B or white key stems 2W and the upper surface of the contact section, constitutes a moment arm length for causing rolling of the key stems 2B, 2W. The moment arm lengths are dw for the white stems 2W and db for the black stems 2B.

Rolling is a rotating motion of a key about an axis extending along the longitudinal axis passing from the free end of the key through to the connection point. As can be understood from FIG. 16, the black keys 2B have a longer moment arm than the white keys 2W (i.e., dw<db).

When a glissando play is performed on the keyboard of the conventional design, key stems are subjected to forces to cause their rolling motion. When the rolling moment, given by a product of the lateral forces and the moment arm lengths (db, dw), is applied to the connection section 4, because the connection section 4 is connected to the key support section 3 flexibly to permit free vertical swinging of the key stems 2B or 2W, a large moment can cause a large amount of rolling motion. Rolling motion of the keys is not desirable for good performance. Especially, because the black keys protrude further upwards compared with the white keys, their moment arm lengths are larger and more susceptible to rolling.

Therefore, the final object of the present invention is to improve the resistance to rolling in the keyboard apparatus.

SUMMARY OF THE INVENTION

A keyboard apparatus of the present invention has a series of key units in which key stems are connected to a key support section through a connection section, and the keyboard apparatus is constituted by these units which are stacked vertically so that the connection sections partially overlap. Furthermore, the back-end of the key stem is attached to the transverse midpoint of the connection section so that the elastic yawing factor of each key is high; and the width in the transverse direction of the connection section is wider than that of the back-end of the key stem attached to the connection section so that the resistance to the yawing and rolling of the key stem in the transverse direction is strengthened.

Or, the lateral surfaces of the adjacent key units in the upper component may be arranged so that they lie substantially on a common plane.

Further, the transverse overall width of each connection section in the lower component may be made wider than the transverse overall width of each connection section in the upper component.

Further, in each key unit, the key unit which is to be place on the highest-note-side of the keyboard is provided with an extra key by attaching a new key for the highest-note integrally to a common key support section. In this case, the key support section is formed in such a way that a portion joining the new key stem to a remaining portion of the highest-note-key unit may be separated by fold bending.

Further, the present invention provides a keyboard apparatus in which the key stems, key support sections and connection sections are resin molded into a molded unit, and the connection sections are provided with an overall transverse width dimension which is wider than the back-end width dimension of the key stems, and are stacked vertically so that a portion of a connection section of a key stem vertically overlaps a portion of another connection section of an adjacent key stem; and each connection section is comprised by a thick section and a thin section so that the thick section is attached to a back-end of each key stem and the thin section joins the thick section to each key support section.

On the other hand, the present invention also provides a keyboard apparatus comprised by connection sections whose transverse overall width is wider than the width dimension of the back-end of the key stems and a portion of a connection section of a key stem vertically overlaps a portion of another connection section an adjacent key stem; and having a first white key unit and a second white key unit, in which each key unit has white key stems, connection sections and key support sections, and black keys are arranged in a black key unit having black key stems, connection sections and key support sections; so that the first white key unit, the second white key unit and the black key unit are assembled by stacking respective key support sections of each key unit vertically and screw fastening to the base section in such a way that screw heads will be in contact only against key support sections of the black key units.

Further, the present invention also provides a similar keyboard apparatus as above, in which the key support sections are stacked so that the key support sections of the black key units are at the topmost layer in a keyboard assembly.

BRIEF DESCRIPTION OF THE DRAWINGS

FIG. 1(*b*) is a cross sectional view of the assembly arrangement of FIG. 1(*a*).

FIG. 2(*b*) is a right side view of the same assembly.

FIG. 3(*b*) is a right side view of the same unit shown in FIG. 3(*a*) of the same assembly.

FIG. 4(*b*) is a right side view of the second white key unit shown in FIG. 4(*a*).

FIG. 6(*b*) is a plan view of a preferred example of the white key unit in the first embodiment, showing the dimensions in a cross sectional view along a line X—X.

FIG. 6(*c*) is a plan view of a comparison example of the white key unit in the first embodiment, showing the dimensions in a cross sectional view along a line X—X.

DESCRIPTION OF THE PREFERRED EMBODIMENTS

In the following, the present invention will be explained with reference to some examples of preferred embodiments.

Figure 1A:
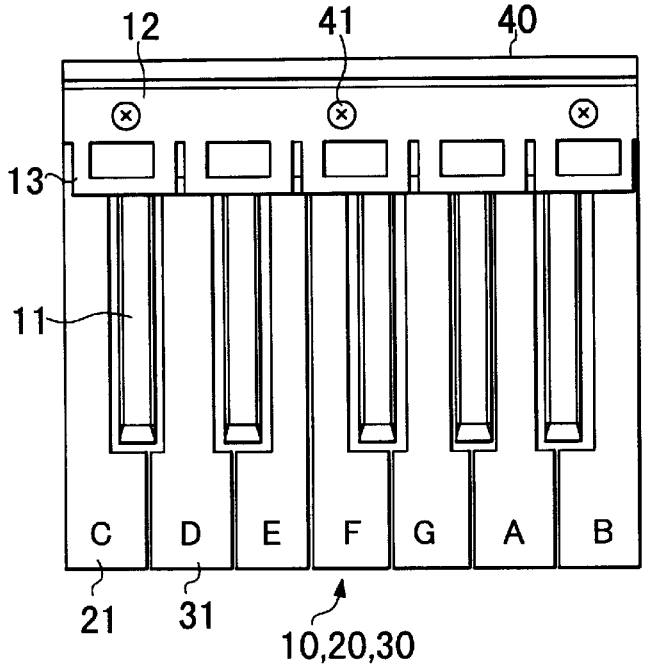
FIG. 1(*a*) is a plan view of an assembly arrangement of the keys for one-octave key unit in the keyboard apparatus of the present invention.
Figure 1B:
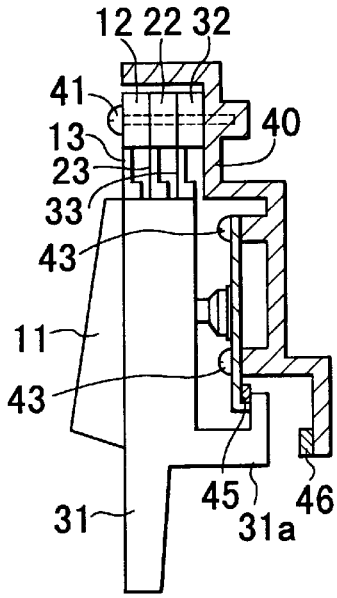
Figure 2A:
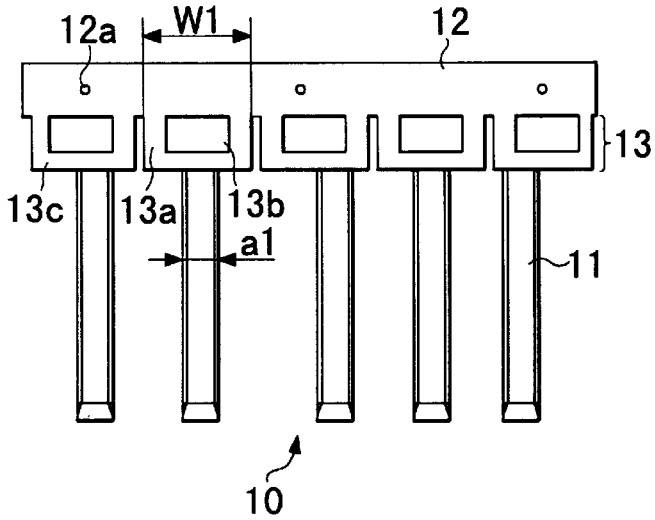
FIG. 2(*a*) is a plan view of the black key unit in the same assembly.
Figure 2B:
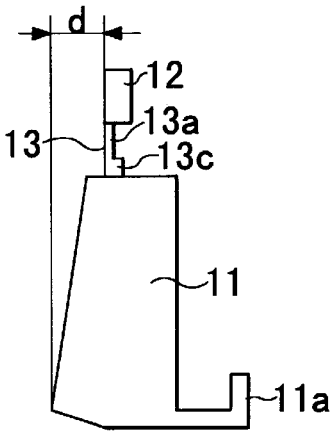
Figure 3A:
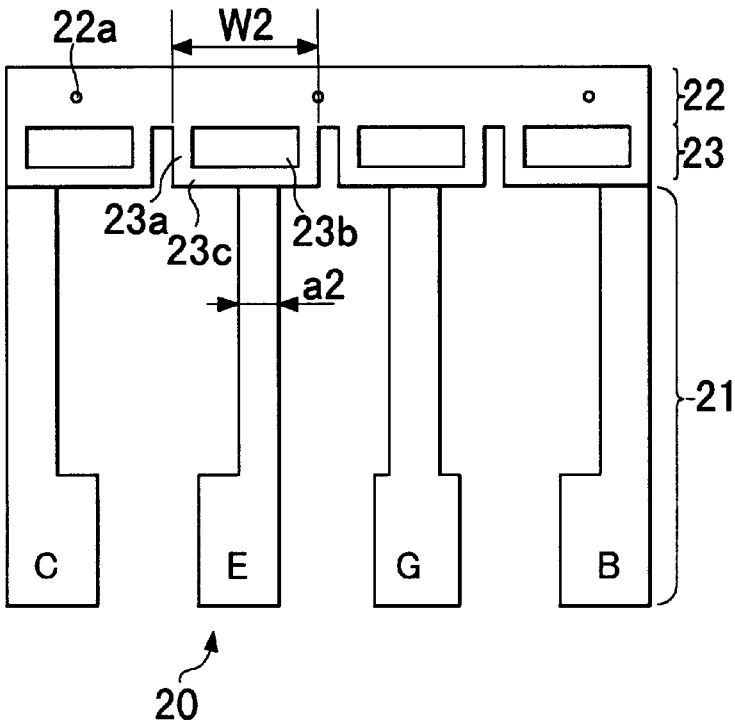
FIG. 3(*a*) is a plan view of a first white key unit (the upper component) of the same assembly.
Figure 3B:
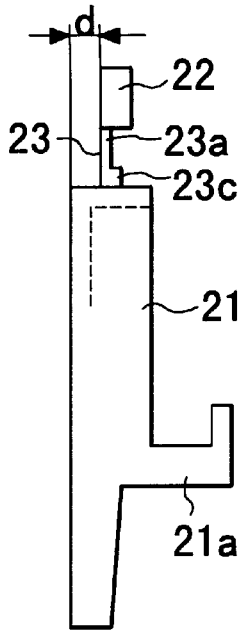

A first embodiment is presented in FIGS. 1–4. FIGS. 1(*a*), 1(*b*) show a plan view and a right side view, respectively, of the key assembly over one octave; FIGS. 3(*a*), 3(*b*) show the same for the white key unit (upper unit); and FIGS. 2(*a*), 2(*b*) show the same for the black key unit (lower unit).

The black key unit 10 shown in FIG. 2 is comprised by five stems of the black key stems (C#-, D#-, E#-, G#- and A#-key) 11, a key support section 12 which extend in the transverse direction of the key stems 11, and connection sections 13 for connecting each black key stem 11 to a key support section 12 so as to enable the keys to vertically swing in a depressed or undepressed direction, all of which are resin molded into one piece. The key support section 12 has a series of screw holes 12*a*. The black key stems 11 have integrally formed L-shaped stopper pieces 11*a* at the bottom front ends.

The connection section 13 has a window section 13*b* to reduce the effective width of the thin section (hinge section) 13*a* connecting the black key stem 11 to the key support section 13 so that the depression motion can be performed easily. Also, the portion of the connection section 13 which is directly joined to the back-end of the black key stem 11 is made into a thick section 13*c*, whose thickness is thicker than the thin section 13*a*, over its entire width W1. In other words, the black key stems 11 are connected to the key support section 12 through a pair of thin sections 13*a*.

The overall width W1 in the transverse direction of the connection section 13 is made wider than the width a of the back-end of the black key stem 11, thereby increasing the elastic yawing factor of the key to strengthen the resistance to yawing of the black key stems 11 in the transverse direction, and thereby eliminating the necessity for key guides. Also, in the stacked condition, a part of the connection section 13 overlaps the connection section of the adjacent key (connection section 23, 33 for the white keys which will be presented later) with a small space therebetween.

The first white key unit 20 shown in FIG. 3 is comprised by 4 pieces of the white key stems 11 (C-, E-, G- and B-keys) 21, a key support section 22 which extends in the transverse direction, and connection sections 23 for connecting the white key stems 21 to the key support section 12 so as to enable the keys to vertically swing in a depressed or undepressed direction, all of which are resin molded into one piece. The key support section 22 has a series of screw holes 22*a*. The white key stems 21 have integrally formed L-shaped stopper pieces 21*a* at the bottom front ends.

The connection section 23 has a window section 23*b* to reduce the effective width of the thin section (hinge section) 23*a* connecting the white key stems 21 to the key support section 23 so that the vertical swing motion can be performed easily. Also, the portion of the connection section 23 which is directly joined to the back-end of the white key stem 21 is made into a thick section 23*c*, whose thickness is thicker than the thin section 23*a*. over its entire width W2. In other words, the white key stems 21 are connected to the key support section 22 through a pair of thin sections 23*a*.

The overall width W2 in the transverse direction of the connection section 23 is made wider than the width $a_2$ of the back-end of the white key stem 21, thereby increasing the elastic yawing factor of the key to strengthen the resistance to yawing of the white key stems 21 in the transverse direction, and thereby eliminating the necessity for key guides. Also, in the stacked condition, a part of the connection section 23 overlaps the connection section of the adjacent key (connection section 13 for the black key, and connection section 33 for the white keys which will be presented later) vertically with a small space therebetween.

In the white key unit 20, the lateral end surfaces (left and right end surfaces in FIG. 3(*a*)) of all the adjacent keys in the upper units arranged in the transverse direction lie substantially on one plane from the white key stems 21 to the connection sections 23.

The key arrangement such as the one shown in FIG. 3(*a*), having connection locations, between the back-end of the white key stems 21 and the connection sections 23, that are biased towards the transverse ends (in FIG. 3(*a*), C- and B-keys) lowers the elastic yawing factor. However, because the first white key unit 20 is an upper unit, the distance d shown in FIG. 3(*b*), between the upper surfaces of the white key stems 21 and the connection section 23, is shorter than the corresponding distance in the second white key unit 30, which is a lower unit (will be described later), therefore, the elastic yawing factor is relatively high. Therefore, even with a construction shown in FIG. 3(*a*), elastic yawing factor does not decrease greatly.

Figure 4A:
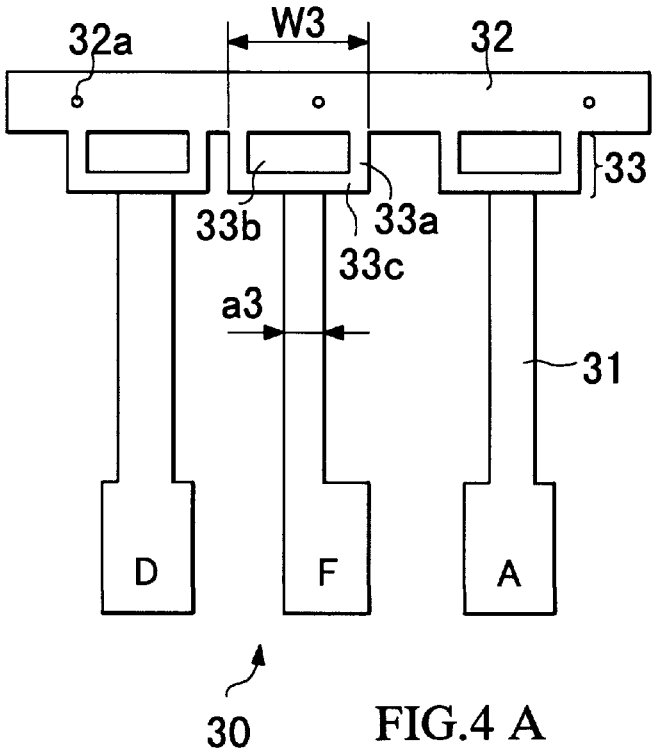
FIG. 4(*a*) is a plan view of a second white key unit (lower component) of the same assembly.
Figure 4B:
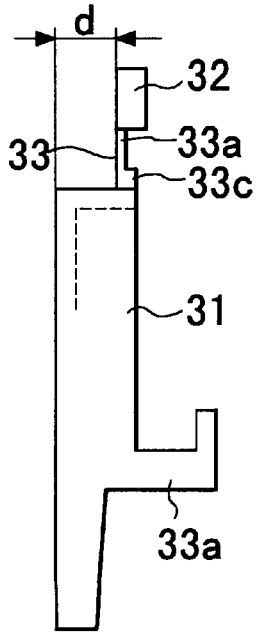

The second white key unit 30 shown in FIG. 4(*a*) is comprised by three white key stems (D-, F-, A-keys) 31, a key support section 32 extending in the transverse direction, and connection sections 33 for connecting the white key stems 31 to the key support section 32 so as to enable the keys to vertically swing in a depressed or undepressed state, all of which are resin molded into one piece. The key support section 32 has a series of screw holes 32*a*. The white key stems 31 have integrally formed L-shaped stopper pieces 31*a* at the bottom front ends.

The connection section 33 has a window section 33*b* to reduce the effective width of the thin section (hinge section) 33*a* connecting the white key stems 31 to the key support section 33 so that the vertical swing motion can be performed easily. Also, the portion of the connection sections 33 which is directly joined to the back-end of the white key stem 31 is made into a thick section 33*c*, whose thickness is thicker than the thin section 33*a*, over its entire width W3. In other words, the white key stems 31 are connected to the key support section 32 through a pair of thin sections 33*a*.

The overall width W3 in the transverse direction of the connection section 33 is made wider than the width $a_3$ of the back-end of the white key stem 31, thereby increasing the elastic yawing factor of the key to strengthen the resistance to yawing of the white key stems 31 in the transverse direction, and thereby eliminating the necessity for key guides. Also, in the stacked condition, a part of the connection section 33 overlaps the connection section of the adjacent key (connection section 13 for the black key, and connection section 23 for the white keys) vertically with a small space therebetween.

However, because the second white key unit 30 is a lower unit, the distance d shown in FIG. 4(*b*), between the upper surfaces of the white key stems 31 and the connection section 33, is longer than the corresponding distance d in the first white key unit (upper unit) 20, therefore, the elastic yawing factor becomes low. Therefore, in the second white key unit 30, the back-ends of the white key stems 31 are joined to a transverse midpoint of each of the connection sections 33 to reduce the loss of elastic yawing factor.

The black key unit 10, first white key unit 20 and second key unit 30, having the structure described above, are assembled into a keyboard of one-octave unit by stacking the key support sections 12, 22 and 32, as shown in FIG. 1(*b*), with screws inserted into each screw hole 12*a*, 22*a* and 32*a* to fasten them to a base section 40 which constitute the key frame.

On the base section 40, a printed circuit plate 42 is attached approximately parallel with the keys 11, 21 and 31 with screw fasteners 43, as shown in FIG. 1(*b*), and on the top surface of the printed circuit plate 42, a key switch 44 having a dome-shaped elastic part is provided for each key. The dome-shaped elastic part provides the spring-back force for each of the keys 11, 21 and 31.

At the front end of the bottom surface of the printed circuit plate 42, upper limit stopper pieces 45 made of such shock absorbing materials as felt are provided, along the transverse direction. The upper limit stopper piece 45 limits the top position of the keys by abutting against the stopper pieces 11*a*, 21*a* and 31*a*.

On the front end of the top surface of the base section 40, lower limit stopper pieces 46 made of such shock absorbing materials as felt along the transverse direction for the bottom limits of the keys are provided so that the depressed keys abut against the stopper pieces 11*a*, 21*a* and 31*a*.

In this embodiment, the black key unit 10 is located on the top of key units 10, 20, and 30, as shown in FIGS. 1–4. Further, the overall width W1 in the connection section 13 in the black key unit 10 is made narrower that the key width at the white key units 20, 30, as shown in FIGS. 2–4, thereby minimizing the drop in the yawing factor of the white key units (lower units) 20, 30, which is always lower than that in the black key unit (upper unit) 10, so that the yawing factors in the upper and lower units are relatively uniform.

Furthermore, in this embodiment, the key support section 12, 22, 32 are stacked so that the heads of the 41 screws make contact with the key support section 12 of the black keys unit 10. This results in a large frictional forces between the seat surface of the heads of the screws 41 and the upper surface of the key support section 12. Therefore, key support section 12 is subjected to a twisting stress by the tightening action of the screws 41, but because the black key stems 11 are shorter than the white key stems 21, 31, the small amount of misalignment in the keys are not very noticeable. In other words, the appearance problem of misaligned white keys posed by the screw torque can be avoided. Further, because the moment arm length d on the black keys shown in FIG. 2(*b*) is minimized, and the rolling effect on the black keys is also lessened.

If is only desired to avoid misalignment of the white keys, it is acceptable to arrange the base section 40 at the top and the key support section 12 of the black key unit 10 at the bottom, when viewed from above the keyboard, and tighten the assembly with the screws 41 inserted from the bottom.

Figure 5:
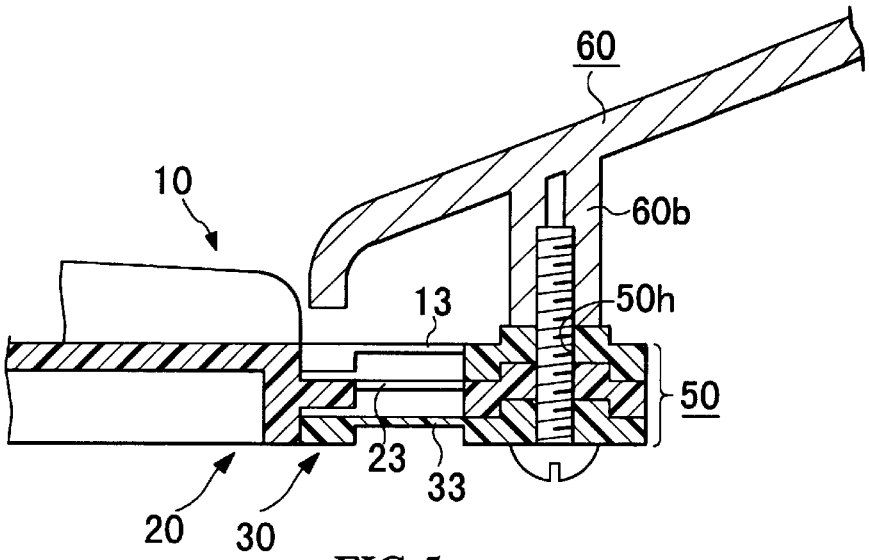
FIG. 5 is a cross sectional side view of the main section of a first embodiment of the keyboard apparatus of the present invention.

FIG. 5 is a cross sectional view of the essential parts of the keyboard apparatus according to the present invention, and the same reference numerals are used for those parts which are the same as those in FIGS. 1–4.

In this embodiment, the black key unit 10 is stacked above the two white key units 20, 30 as in the previous embodiment, but the screws 41 are inserted through the screw holes 50*h* from underside of the key support section 50 of the three-layer assembly unit into the boss section 60*b* of a panel 60, and the whole unit is firmly attached to the panel (base section) 60 disposed above the assembly.

In this embodiment, it is not necessary to use the screws for fastening the keyboard units to the base section, and other methods such as eyelet fastening and rivet fastening can be used. In rivet fastening, the protruding tip (bottom end) of the rivets embedded into the panel is inserted into the hole 50*h* of the key support section 50, and the tip is crushed for attachment.

According to this embodiment, as in the pervious embodiment, the misalignment of the white keys as well as reduction in rolling of the black keys are both achieved. Also, the white key units can be arranged on the upper side of the case. Furthermore, the because the key guides are not used, the upper case does not have a complex structure so that the upper case and the keyboard frame can be made into a single unit for an electronic musical instrument.

Figures 6A, 6B, 6C:
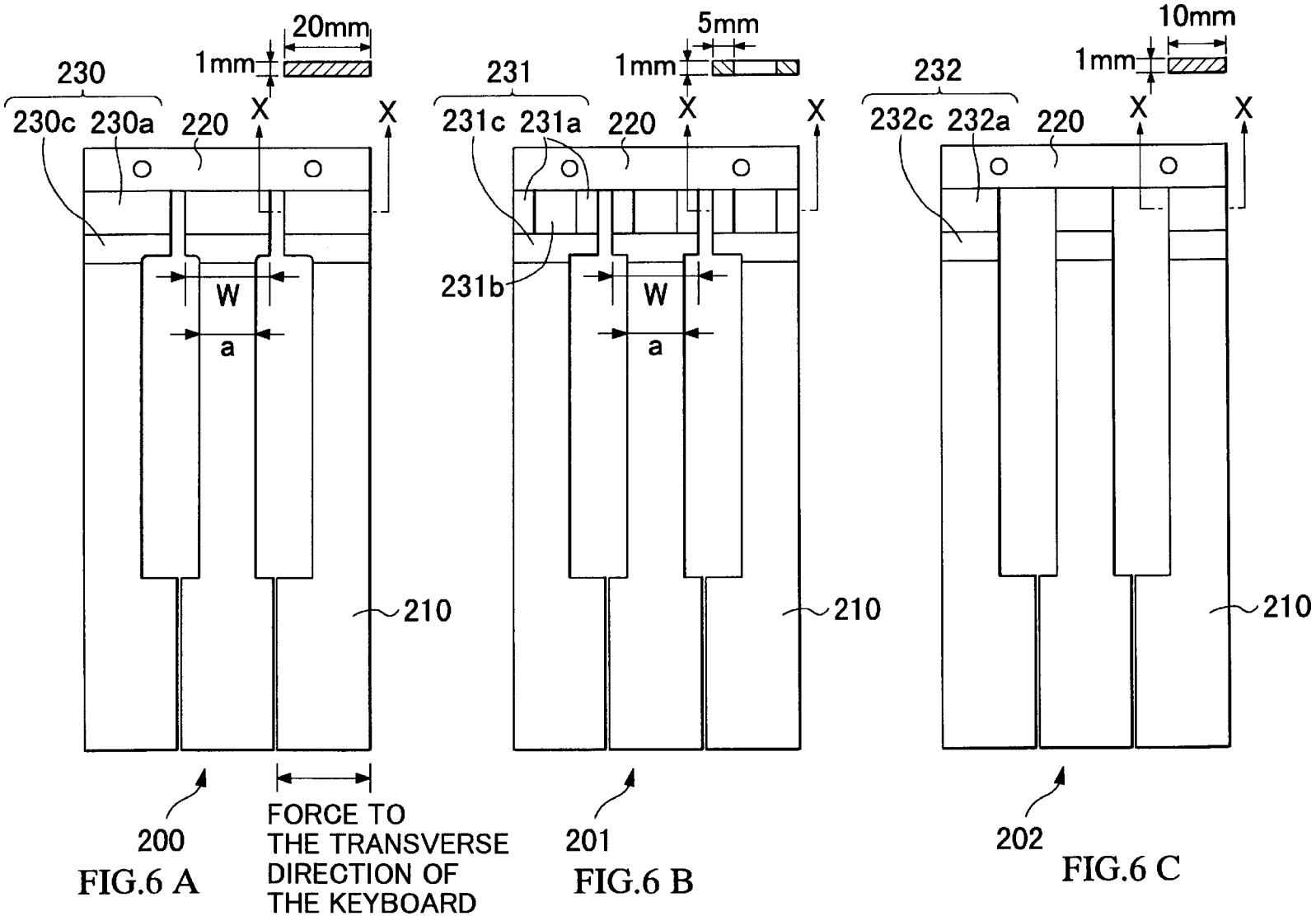
FIG. 6(*a*) is a plan view of a basic example of the white key unit, in the first embodiment, showing the dimensions in a cross sectional view along a line X—X.

Next, two other embodiment of the connection section 23 will be presented with reference to FIGS. 6(*a*)–6(*c*). FIG. 6(*a*) is a plan view of a white key unit of the basic example in another embodiment and an edge view showing the dimensions of a cross section through a plane X—X; FIG. 6(*b*) is a plan view of a white key unit of a preferred example of the basic model and an edge view showing the dimensions of a cross section through a plane X—X; and FIG. 6(*c*) is a plan view of a white key unit of a comparative example and an edge view showing the dimensions of a cross section through a plane X—X.

Although the keyboard in this embodiment is similar to that presented in FIGS. 1–4, the number of keys belonging to a key unit and the shape of the connection section are somewhat different.

As in the white key unit 200 shown in FIG. 6(*a*) or the white unit 201 shown in FIG. 6(*b*), the white key unit of this embodiment is comprised by key stems 210; a key support section 220 for supporting the key stems 210; and connection sections 230 or 231 to allow free swinging of the key stems 210 about the key support section 220 in the depression direction.

The connection sections 230, 231 have a transverse width W which is wider than the width "a" of the back-ends of the key stems 210, and partly vertically overlaps the connection sections of the adjacent keys over a small spacing. Also, the key support section 220 connects a plurality of key stems 210 through their respective connection sections 230, 231. The key support section 220 and a plurality of key stems 210 and the connection sections 230, 231 are all formed into one resin molding.

The connection sections 230, 231 are comprised of thick sections 230*c* or 231*c* attached to the back-ends of the key stems 210 and the thin sections 230*a* or 230*a* connecting the thick section and the key support section 220. By adopting this design, the key stems 210 is able to freely swing vertically with respect to the key support section 220 in the key depression direction, and transverse movement of the keys is restricted.

However, in the connection sections 230 of the white key unit 200, the thick section 230*c* and thin section 230*a* both have a uniform width W. On the other hand, in the connection sections 231 of the white key unit 201, the width W of the thick section 231*c* is wider than the width of the key stem 210, and a pair of thin sections 231*a* are provided on both transverse ends of the thick section 231*c* with a window section 231*b* in the center.

In this case, those parts of the connection sections 230, 231 which connect the thick section 230*c*, 231*c* to the back-end of the key stems are connection sections 230*c*, 231*c* which are in turn connected to thin sections 230*a*, 231*a*, and for these connections to be able to freely swing vertically in the key depression direction, it is necessary that the parts be made flexible by making the thickness of the connection section as thin as practical. However, if the entire connection section is made of a thin material, repeated depression actions may subject the connection sections to eventual fatigue damage. This problem is resolved by making those parts in the connection sections 230, 231 which connects to the back-end of the key stems to be thick sections 230*c*, 231*c*, and making those parts which connect to the key support section 220 to be thin sections 230*a*, 231*a*.

Other methods of providing high flexibility in the key depression action include making the thin sections thinner and reducing the transverse width of the thin section. However, if the thin section is made too thin, flow of resin through the thin section is affected during the molding operation. So, to provide sufficient flexibility while maintaining good formability and restricting transverse movement of the keys, a window section 231*b* is provided in the middle of the thin section 231*a*, as in the case of white key unit 210 shown in FIG. 6(*b*), to retain the overall width W of the connection section 231 but to reduce the effective width of the thin section 231*a*.

For example, when the thickness of the thin sections 230*a*, 231*a*, 232*a* for the connection sections 230, 231, 232 for the white key units 200, 201 and 202 (shown in FIG. 6(*a*)–6(*c*)) is 1 mm in each case, the second moment of area in the transverse direction is 667 $mm^4$ for a key width of 20 mm of the white key unit 200.

In contrast, in the connection sections 231 in the white key unit 201 shown in FIG. 6(*b*), the width of the thick section 231C is W, but because of the provision of the window section 231*b* of a width approximately W/2 in the middle of the thin section 231*a*, the width of each thin section 231*a* becomes about W/4, and stiffness in the key depression direction is about a half of the white key unit 200. However the second moment of area is about 583 $mm^4$, and is nearly unchanged compared with the white key unit 200.

On the other hand, the white key unit 202 shown in FIG. 6(*c*) is a comparative example, and is comprised by connection sections 232 (for connecting the key stems 210 to the key support section 220) having a thick section 232*c* and a thin section 232*a* of about the same width as the back-end of the key stems 210.

In this design, the stiffness in the key depression direction is about a half of the white key unit 200, which is similar to the case of white key unit 201. But, the second moment of area in the transverse direction is about 83 $mm^4$ which is only 12% of the key unit 200.

Figure 7:
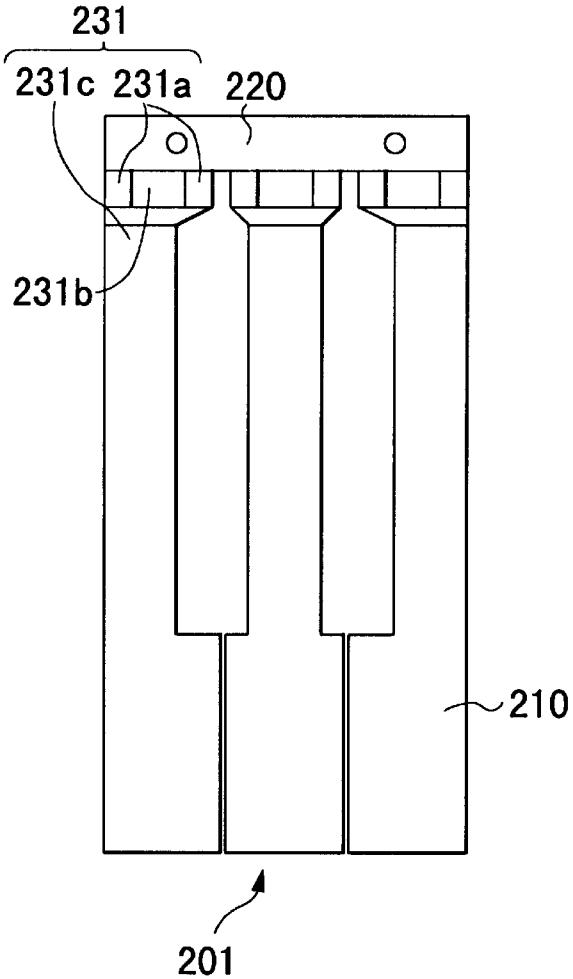
FIG. 7 is a plan view of a variation of the preferred embodiment the white keyboard unit.

FIG. 7 is a plan view of a variation of the white key unit 201 shown in FIG. 6(*b*), and the parts which are the same as those in FIG. 6(*b*) are referred to using the same reference numerals.

In this example, the shape of the thick section 231*c* in the connection section 231 is a trapezoid and the side that connects to the key stems 210 has the same width as the back-end of the key stems 210 and the side that connects to the thin section 231*a* is wider. Other structures are the same as those shown in FIG. 6(*b*). This design of the keyboard also produced essentially the same effects as the design shown in FIG. 6(*b*).

Other white key units and black key units can also be made according to FIGS. 6(*a*), 6(*b*) or FIG. 7, to produce the same effects. Those key boards shown in FIGS. 1–4 also produce the same effects as the keyboard shown in FIG. 7.

The electronic musical keyboard may be produced by assembling keyboards similar to the ones shown in FIGS. 1–4, for several octaves on a single base section 40.

Figure 8:
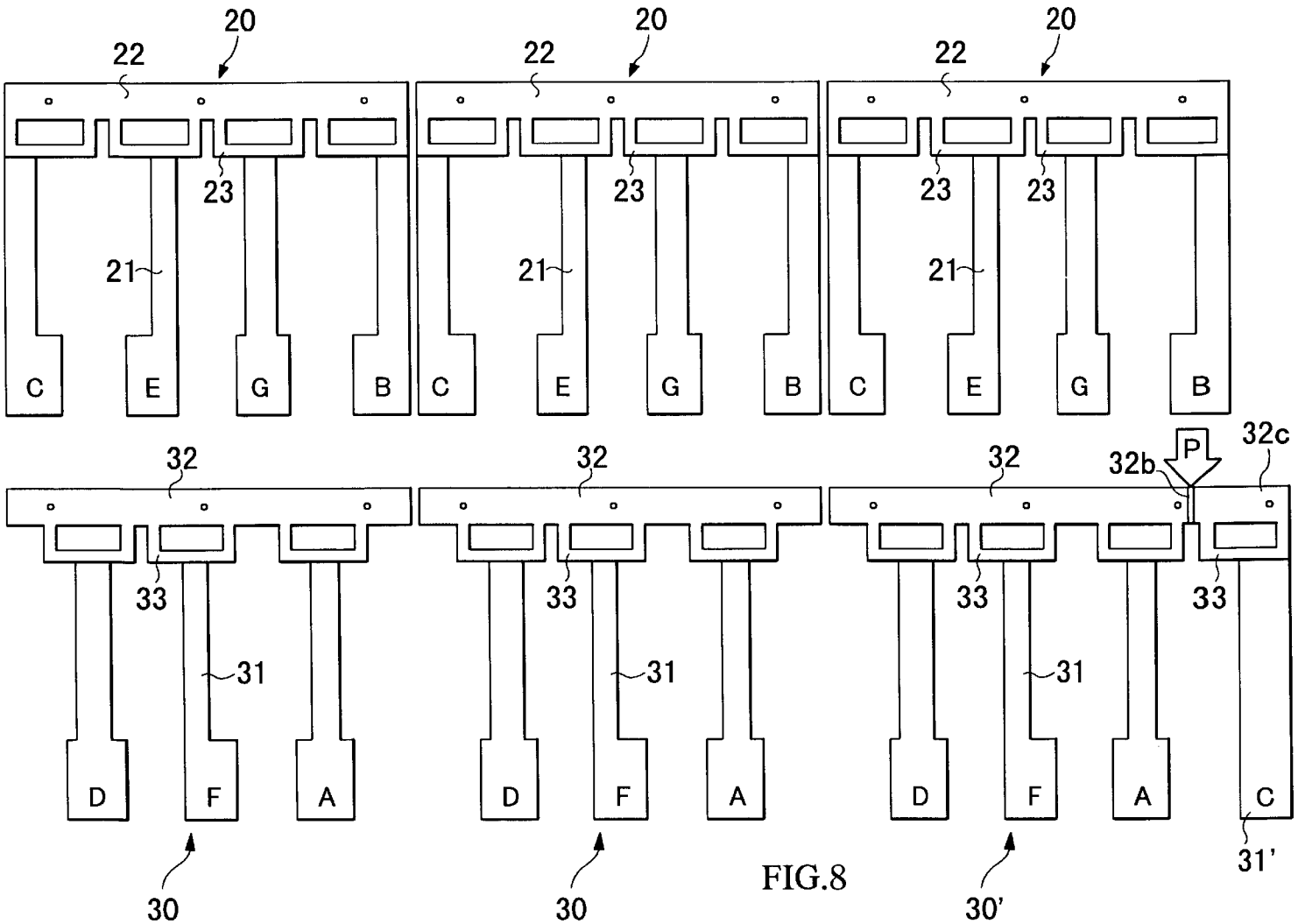
FIG. 8 is a plan view of an example of the connective arrangement of the first white key unit and the second white key unit.

FIG. 8 shows a plan view of a C37-scale keyboard assembled by connecting a first white key unit (upper component) 20 to a second white key unit (lower component) 30.

The white key stems 21, 31 have cutouts to correspond with the black key stems 11 on opposing lateral surfaces of the left and right stems or on one stem so that the black key stems 11 may be placed in between, as shown in FIG. 1. Specifically, on right lateral surface for C- and F-keys; on left lateral surfaces on E-and B-keys; on both lateral surfaces on D-, G- and A-keys.

Also, the first white key unit 20 which is an upper component, the white stems 21 are placed so that C-key is on the left end and B-key is on the right end of one unit and E- and G-keys are placed therebetween. Further, a B-key in one white key component 20 and a C-key in the transversely adjacent white key component 20 are joined in such a way that their lateral surfaces will lay on a common plane from the stem 21 to the connection section 23.

Also, the second white key units 30, 30' are provided white key stems 31 for D-, F- and A-keys, and the back-end of each white key stem 31 is joined to a transverse midpoint of the connection section 33 to prevent lowering the elastic yawing factor.

Therefore, it can be seen in FIG. 8 that keys are arranged in such a way that those keys having a low yawing factor (C- and B-keys) are all placed in the upper component which exhibits a relatively large yawing factor, and furthermore, in the lower component which exhibits a relatively small yawing factor, the back-end of the keys are joined to the midpoint of the connection section. The result is that the yawing factor is raised overall and all the spread of yawing factor in the white keys in a keyboard is reduced, and the overall yawing strength is improved.

Further, in the example shown in FIG. 8, that second white key unit 30 on the highest note-side has an extra key stem (in this case, C'-key) 31', adjacent to its highest-note-key, which is integrated into the key support section 32 through its connection section 33. Therefore, in the white key unit 30' on the highest-note-side, there is one extra white key compared with the other white key units 30.

This design enables to avoid a drop in the yawing factor by being a single independent key unit. Additionally, the white C'-key stem 31' does not need a cutout because it is simply adjacent to the B-key stem 21 in the first white key unit 20. Thus, key width is the same throughout longitudinally, so that the joint width to the connection section 33 can be made wide and can be shifted to near the transverse right end so that even though it is placed in the lower unit, its yawing factor is not lowered greatly.

By adopting such a design shown in FIG. 8, it is possible to reduce the spread in the yawing factor for the overall white keys and increase their yawing strength. The result is that the keys are prevented from bumping against the others during playing and the sense of key touch is improved. Also, compared with the case of an independently arranged highest note key, adjustment of key spacing is simpler.

Figure 9:
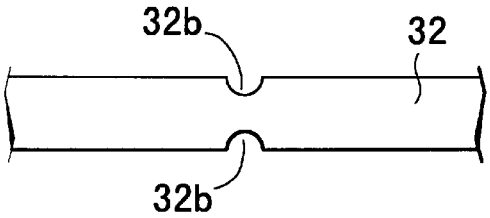
FIG. 9 is a back view of a section indicated by an arrow P in FIG. 8.

Additional feature of the white key unit 30' is that a V-groove, which is indicated in FIG. 8 by an arrow P (to show the viewing direction), is provided between the connection section 33 of the A-key and the connection section 33 for the C'-key in the key support section 32. FIG. 9 shows a back view seen in the P direction of the upper and lower surface V-grooves 32*b* so that the support section 32*c*, which supports the white key stem 31', can be separated from the support section 32 for other white key stems 31, by cutting off the V-groove 32*b* by bend folding.

This approach allows an efficient and economic use of the metal molds. Three molded pieces of the second white key units 30' are made, but the key support section 32*c* is broken off from the two of the three molded pieces, leaving two molded pieces (having no stem 31') to be used as white key units 30 in the lower white key unit. The result is that it is necessary to prepare only two types of metallic molds, a mold for the first key unit 20 and a mold for the second key unit 30'. Therefore, the number of metal molds is reduced and the capital cost can be reduced.

Figure 10:
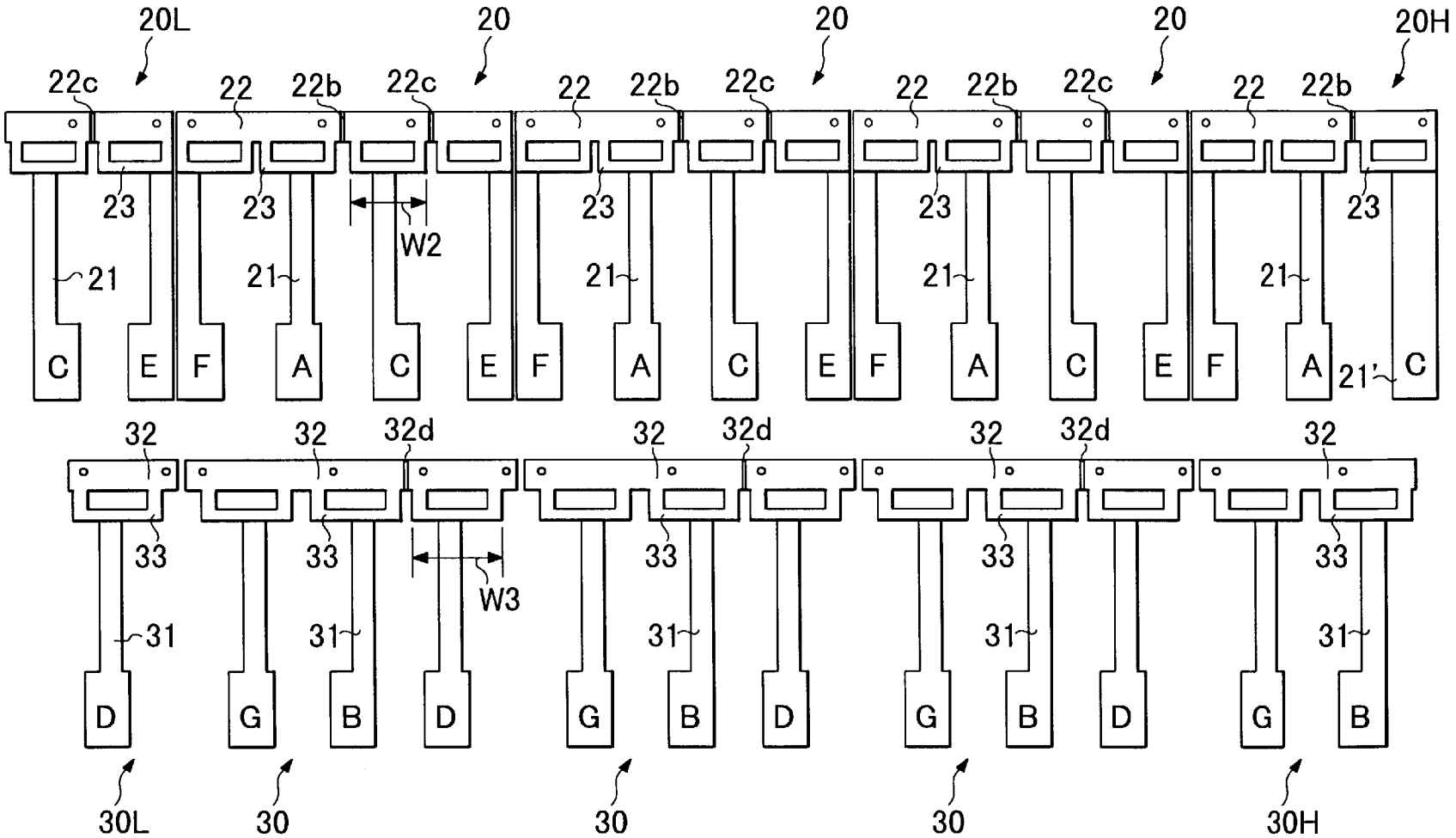
FIG. 10 is a plan view of an example of the connective arrangement of the first white key unit and the second white key unit.

FIG. 10 shows another embodiment of the keyboard apparatus, and is a plan view of a C49-scale keyboard comprised by connecting a first white key unit (upper unit) 20 and a second white key unit (lower unit) 30. In FIG. 10, those parts which are the same as in FIGS. 1–4 and in FIG. 8 are referred to by the same reference numerals, and their explanations are omitted.

In this example, the key units are arranged so that the adjacent white key stems 21 in the connecting first white key units 20 are E- and F-keys, by designating the left end key stems 21 as the F-key as in each of the first white key units 20 and the right end white key stems 21 as the E-key. This arrangement enables the lateral surfaces of the adjacent keys in each white key unit 20 throughout to be on a common plane as in the case shown in FIG. 8. Also, the back-ends of each of the second white key unit 30 are joined in the same manner to the transverse midpoint of the connection section 33 as in the case shown in FIG. 8.

Additionally in this example, the overall width W3 of the connection section 33 in the second white key unit 30 (lower key unit) is made wider than the width W2 of the connection section 23 in the first white key unit 20 (lower unit) such that W2<W3. This arrangement of the keys prevents the yawing factor to decrease in the lower unit compared with the upper unit so that the keys in both units 20, 30 would have relatively uniform yawing factors.

Here, similar grooves as shown in FIGS. 8, 9 are again provided in the first white key unit 20 between the connection sections 23 for A- and C-keys in the key support sections 22 and between the connection sections 23 for C- and E-keys, excepting in the lowest note side unit 20L and the highest note side unit 20H.

Using this approach, by braking the first white key molded piece at the V-groove 22*b*, a low-note-side unit 20L is produced having C- and E-keys remaining on the right of the molded piece. Therefore, although the first white key component 20 include three key unit types, consisting of 20, 20L and 20H, only two types of metal molds for producing key unit 20, 20H are needed to be prepared.

It should be noted that the highest note side unit 20 has a key stem 21' for generating the highest note (in this example, C'-key) having a wide key width integrally joined to the key support section 22 through the connection section 23. The beneficial effect is the same as that in the case presented in FIG. 8.

In this example, the second white key unit 30 is also provided with a groove 32*d* similar to groove 32*b* shown in FIGS. 8 and 9, except in the low-note-side unit 30L and the highest-note-side unit 30H.

Therefore, by breaking the second white key molded piece at the groove 32*d*, the section on the right having D-key can be used as the low-note-side unit 30L, and the section on the left having G- and B-keys can be used as the highest-note-side unit 30H. Therefore, although the keyboard is comprised by three types of key units 30, 30L and 30H, it is only necessary to prepare one type of metal mold.

As explained above, in this example, only two types of metal molds are needed so that the capital cost is reduced.

Also, by not using the low-note-side unit 20L and the low-note-side unit 30L, respectively, in the first white key unit and in the second white key unit, a F44-scale keyboard apparatus can be configured.

Figure 11:
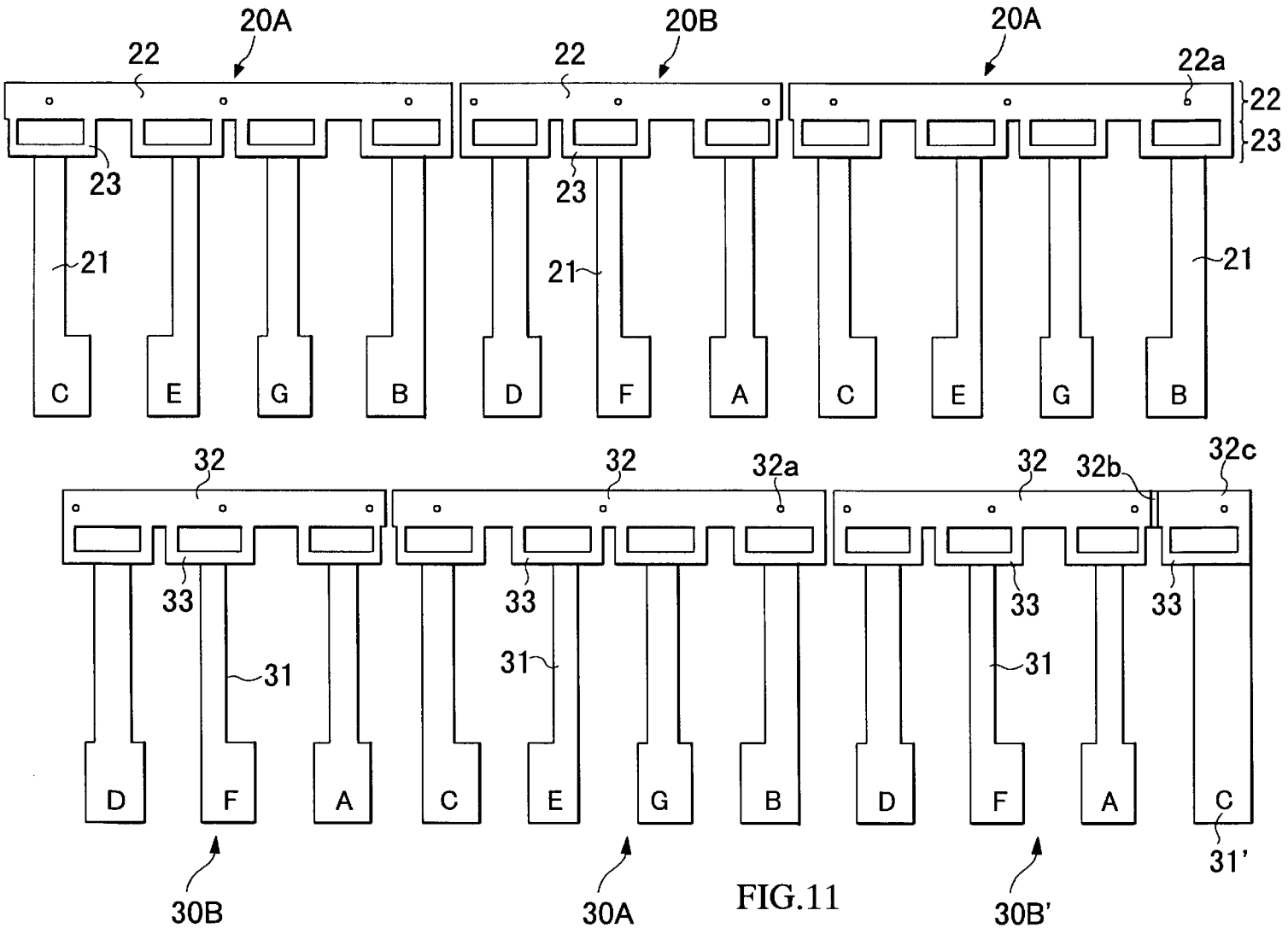
FIG. 11 is a plan view of another example of the connective arrangement of the first white key unit and the second white key unit.

FIG. 11 shows another embodiment, and is a plan view of connecting a first white key units (upper unit) 20 and a second white key units 30 to form a C37-scale keyboard apparatus. In FIG. 11, those parts which are the same as those in FIGS. 1–4, FIGS. 8–10 are referred to by the same reference numerals, and their explanations are omitted.

In this example, the first white key unit or upper unit is comprised by two kinds of first white key units 20A (two units) and 20B (one unit). The first white key unit 20A has key stems 21 arranged from the left as C-, E-, G- and B-keys, and in the first white key unit 20B, the key stems 21 are arranged from the left as D-, F- and A-keys.

The second white key unit or lower unit is comprised by three kinds of first white key units 30A, 30B and 30B' (one unit each). The second white key unit 30A has key stems 31 arranged from the left as C-, E-, G- and B-keys, which is the same arrangement as in the first key unit 20A. In the second white key unit 30B, the key stems 31 are arranged from the left as D-, F- and A-keys, which is the same arrangement as the first white key unit 20B.

It should be noted that in the second white key unit 30B', which is disposed on the highest-note-side, has an A-key of a highest-note-key stem 31' of a wide key width is disposed adjacent to the A-key at the right in the second white key unit 30B, for generating a still higher note (in this example, C'-key) integrally joined to the key support section 32 through the connection section 33. The beneficial effect is the same as that in the case presented in FIG. 8.

In this example, drop in the yawing factor is prevented by joining the back-end of all the white key stems 21, 31 to the transverse midpoint of the connection sections 23, 33. That is, in the case shown in FIG. 11, in addition to the lower unit, the upper unit also has the back-ends of the key stems joined to the transverse midpoint of the connection section to increase the yawing factor. The result is that the yawing factor for all the white keys in the keyboard is increased, and the yawing strength is increased overall.

Figure 12:
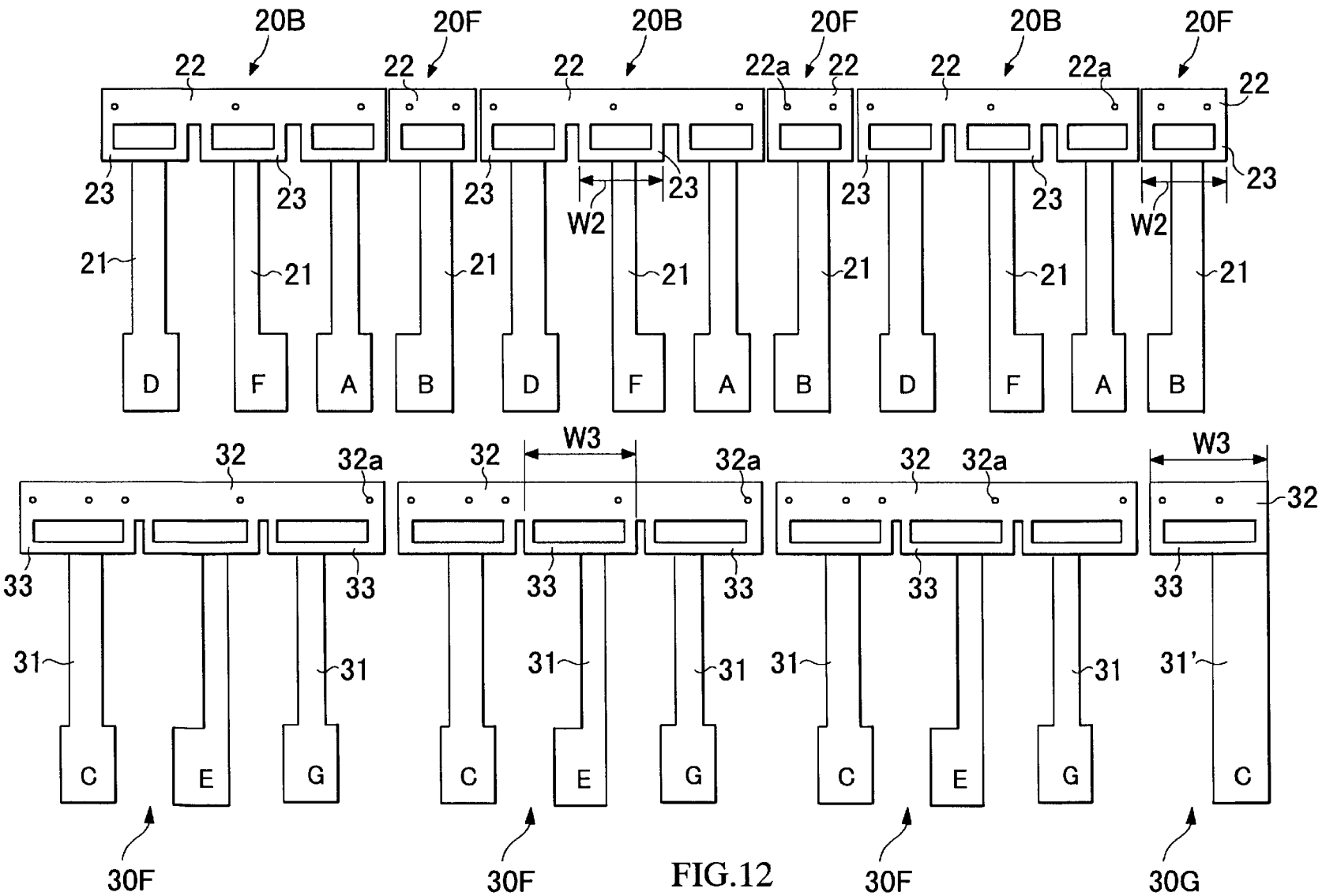
FIG. 12 is a plan view of another example of the connective arrangement of the first white key unit and the second white key unit.
Figure 13:
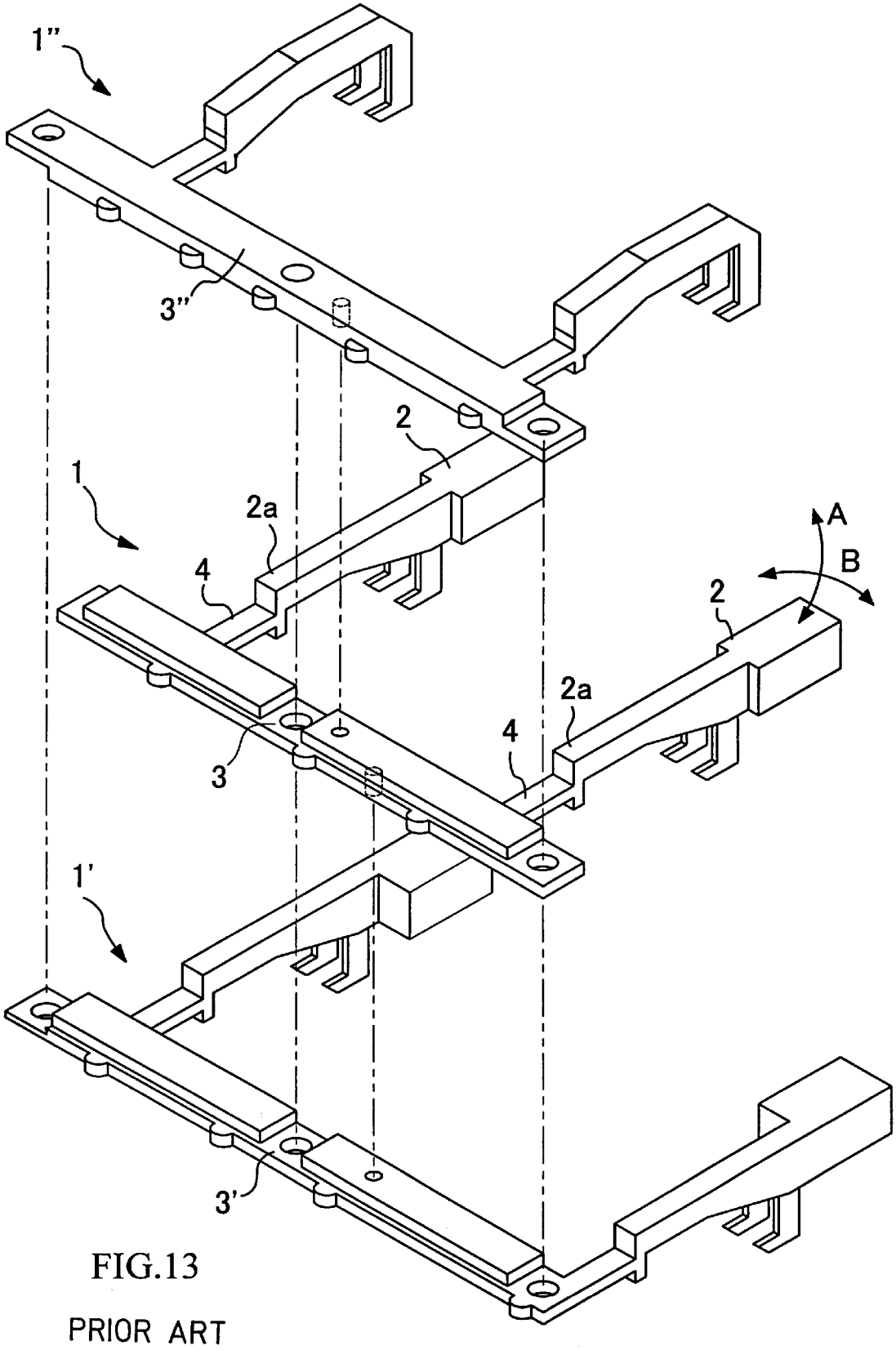
FIG.13 PRIOR ART
FIG. 13 is a perspective view of a disassembled view of a conventional keyboard apparatus.
Figure 14:
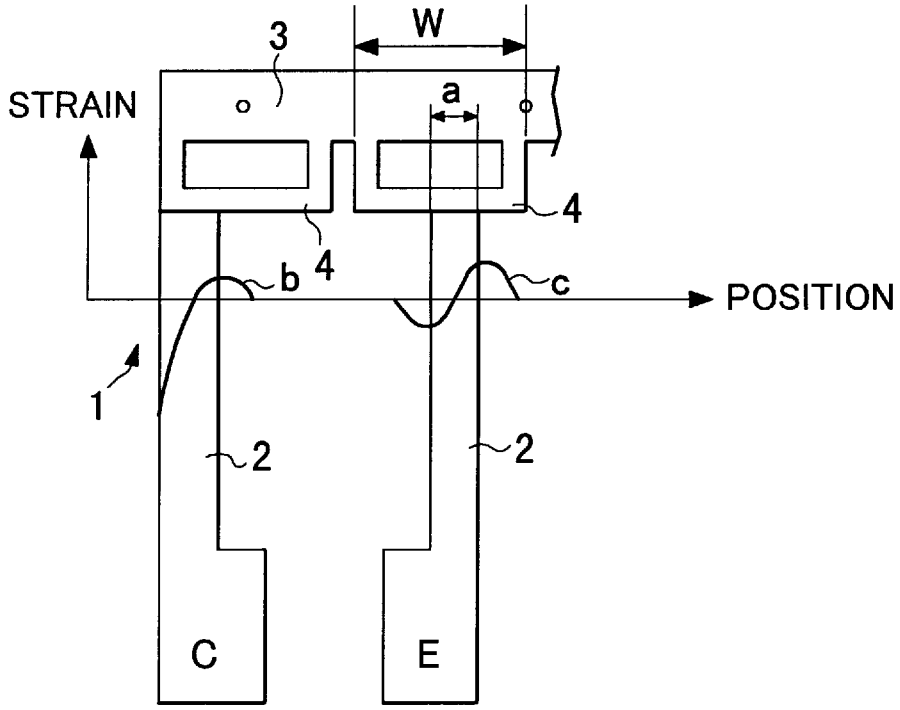
FIG.14 PRIOR ART
FIG. 14 is a plan view of a portion of the white key unit of a conventional keyboard apparatus.
Figure 15:
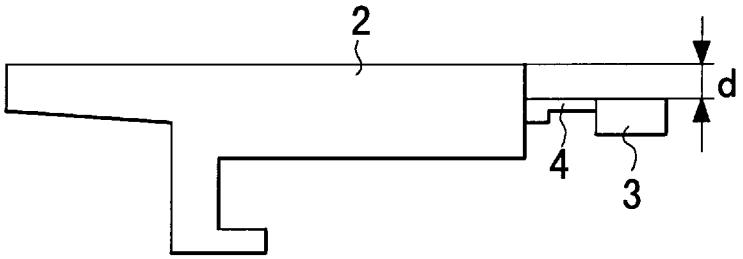
FIG.15 PRIOR ART
FIG. 15 is a side view of the white keys in a conventional keyboard apparatus.
Figure 16:
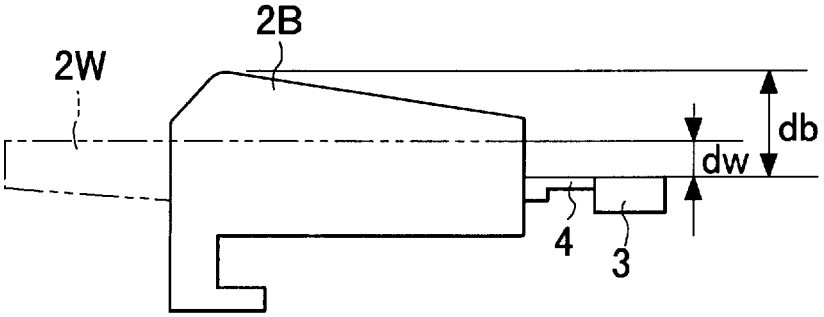
FIG.16 PRIOR ART
FIG. 16 is a side view of the black keys in a conventional keyboard apparatus.

FIG. 12 shows another embodiment and is a plan view of connecting a first white key units (upper unit) 20 and a second white key units 30 to form another C37-scale keyboard apparatus. In FIG. 12, those parts which are the same as those in FIGS. 1–4, FIGS. 8–10 are referred to by the same reference numerals, and their explanations are omitted.

In this example, the first white key unit (upper unit) is comprised by two kinds of first white key units 20B (three units) and 20F (three units). The first white key unit 20B has key stems 21 arranged from the left as D-, F- and A-keys, as in the first white key unit 20B shown in FIG. 11.

The first white key unit 20F has the white key stems 21 for only B-keys. This is because, in the embodiment, the tip space between the A- and B-keys is very small, and it is difficult to make both keys in one metal mold, so that the B-keys are made separately.

The second white key unit or lower unit is comprised by two kinds of first white key units 30F (three units), 30G (one unit). The second white key unit 30F has key stems 31 arranged from the left as C-, E-, G-keys. In the second white key unit 30G on the high-note-side, the only key stems 31' is for the highest-note C-key.

In any of the white key units 20F, 30F, the back-end of the key stems 21, 31 are joined to the midpoint of the connection sections 23, 33, and are joined to the key support sections 22, 32 so as to permit free swinging in the key depression direction through the connection sections 23, 33. Therefore, in either the lower unit or the upper unit, the elastic yawing factors are high.

Also, although the back-end of the key stem 31' in the second white key unit 30G is joined near to the right side of the connection section 33, but the key width is the same longitudinally, and the width of the joint to connection section 33 is also wide, so that the yawing factor does not decrease very much.

Further, in this example also, the overall width W3 in the connection section 33 in the second white key units (lower unit) 30F, 30G is made wider that the key width at the connection section 33 in the first white key units 20B, 20F (W2<W3), thereby minimizing the drop in the yawing factor of the white key stems 31, 31' even in the lower unit, which is always lower than that in the upper unit, so that the yawing factors in the upper and lower units are relatively uniform.

What is claimed is:

1. An electronic musical keyboard apparatus comprising a plurality of key stems arranged in a transverse direction of a keyboard so that each key stem is connected through a connection section to a key support section so as to enable each key stem to swing freely vertically in a key depression direction about a respective key support section, wherein said connection section has a transverse overall width dimension that is wider than a width dimension of a back-end of said key stem, and is disposed so that a portion of a connection section of a key stem vertically overlaps a portion of another connection section of an adjacent key stem; and white keys are arranged in an upper key unit and in a lower key unit, each key unit having respective key stems, a key support section and connection sections; such that the key support section of said upper key unit is stacked on top of the key support section of said lower key unit; and a plurality of assemblies, each assembly comprising said lower key unit and said upper key unit, which is stacked on said lower key unit, being linked in a line along the transverse direction of the keyboard to form an upper component and a lower component; wherein, in said upper component, lateral surfaces of key stems and connection sections of said upper key unit that face the adjacent upper key units lie substantially on a common plane; and, in said lower component, back-ends of key stems in each lower key unit are joined to transverse midpoints of connection sections.

2. An electronic musical keyboard apparatus according to claim 1, wherein said upper component or said lower component is provided with an extra key by providing a highest-note-key unit which is placed at a highest-note-side of said keyboard apparatus by integrally attaching a new key stem to a key support section through a connection section.

3. An electronic musical keyboard apparatus comprising a plurality of key stems arranged in a transverse direction of a keyboard so that each key stem is connected through a connection section to a key support section so as to enable each key stem to swing freely in a key depression direction about a respective key support section, wherein said connection section has a transverse overall width dimension that is wider than a width dimension of a back-end of said key stem, and is disposed so that a portion of a connection section of a key stem vertically overlaps a portion of another connection section of an adjacent key stem; and white keys are arranged in an upper key unit and in a lower key unit, each key unit having respective key stems, key support sections and connection sections; such that the key support section of said upper key unit is stacked on top of the key support section of said lower key unit; and a plurality of assemblies, each assembly comprising said lower key unit and said upper key unit, which is stacked on said lower key unit, being linked in a line along the transverse direction of the keyboard to form an upper component and a lower component; wherein back-ends of key stems in said upper component and in said lower component are joined to transverse midpoints of respective connection sections, wherein a width in the transverse direction of each connection section of said lower key units is wider than a width of each connection section of said upper key units.

4. An electronic musical keyboard apparatus according to claim 3, wherein said upper component or said lower component is provided with an extra key by providing a highest-note-key unit which is placed at a highest-note-side of said keyboard apparatus by integrally attaching a new key stem to a key support section through a connection section.

5. An electronic musical keyboard apparatus comprising a plurality of key stems arranged in a transverse direction of a keyboard so that each key stem is connected through a connection section to a key support section so as to enable each key stem to swing freely vertically in a key depression direction about a respective key support section, wherein said connection section has a transverse overall width dimension that is wider than a width dimension of a back-end of said key stem, and is disposed so that a portion of a connection section of a key stem vertically overlaps a portion of another connection section of an adjacent key stem; and keys are arranged in a first key unit and in a second key unit, each key unit having respective key stems, a key support section and connection sections; such that the key support section of said first key unit is stacked on top of the key support section of said second key unit, and a plurality of assemblies, each assembly being composed of said second key unit and said first key unit which is stacked on said second key unit, are linked in a line along the transverse direction of the keyboard to form a first component and a second component; wherein said transverse overall width of each connection section in said second component is wider than said transverse overall width of each connection section in said first component.

6. An electronic musical keyboard apparatus according to claim 5, wherein said first key component forms black key component and said second key component forms white key component.

7. An electronic musical keyboard apparatus comprising a plurality of key stems arranged in a transverse direction of a keyboard so that each key stem is connected through a connection section to a key support section so as to enable each key stem to swing freely vertically in a key depression direction about a respective key support section, wherein said connection section has a transverse overall width dimension that is wider than a width dimension of a back-end of said key stem, and is disposed so that a portion of a connection section of a key stem vertically overlaps a portion of another connection section of an adjacent key stem; and white keys are arranged in an upper key unit and in a lower key unit, each key unit having respective key stems, key support sections and connection sections; such that the key support section of said upper key unit is stacked on top of the key support section of said lower key unit; and a plurality of assemblies, each assembly comprising said lower key unit and said upper key unit, which is stacked on said lower key unit, being linked in a line along the transverse direction of the keyboard to form an upper component and a lower component; wherein said transverse overall width of each connection section in said lower component is wider than said transverse overall width of each connection section in said upper component.

8. An electronic musical keyboard apparatus according to claim 7, wherein said upper component or said lower component is provided with an extra key by providing a highest-note-key unit which is placed at a highest-note-side of said keyboard apparatus by integrally attaching a new key stem to a key support section through a connection section.

9. An electronic musical keyboard apparatus according to claim 8, wherein said key support section which supports the key stem of said extra key is separably joined to the key support section which supports other key stems of said highest-note-key unit, and said extra key is separable by fold bending of said key support section.

10. An electronic musical keyboard apparatus comprising a plurality of key stems arranged in a transverse direction of a keyboard so that each key stem is connected through a connection section to a key support section so as to enable each key stem to swing freely vertically in a key depression direction about a respective key support section, wherein said connection section has a transverse overall width dimension that is wider than a width dimension of a back-end of said key stem, and is disposed so that a portion of a connection section of a key stem vertically overlaps a portion of another connection section of an adjacent key stem; and white keys are arranged in an upper key unit and in a lower key unit, each key unit having respective key stems, a key support section and connection sections; such that the key support section of said upper key unit is stacked on top of the key support section of said lower key unit; and a plurality of assemblies, each assembly comprising said lower key unit and said upper key unit, which is stacked on said lower key unit, being linked in a line along the transverse direction of the keyboard to form an upper component and a lower component; wherein, each connection section is comprised by a thick section and a thin section so that said thick section is attached to a back-end of each key stem and said thin section joins said thick section to each key support section.

11. An electronic musical keyboard apparatus according to claim 10, wherein said thick section of said connection section has a transverse width that is wider than a width of said key stem, and said thin section is joined to said key support section at the transversal ends of said thick section.

12. An electronic musical keyboard apparatus comprising: a base section; key stems; key support sections; and connection sections to enable each key stem to vertically swing in a key depression direction about a respective key support section; wherein said connection section has an overall transverse width that is wider than a width of back-ends of key stems to be joined to said connection sections, and a portion of a connection section of a key stem vertically overlaps a connection section of an adjacent key stem; said keyboard apparatus comprised by white keys arranged in a first white key unit and in a second white key unit, each key unit having respective white key stems, connection sections and a key support section, and black keys arranged in a black key unit having black key stems, connection sections and a key support section; so that said first white key unit, said second white key unit and said black key unit are assembled by stacking the key support sections of the key units on top of said base section such that the key support section of said black key unit is positioned at the top, and fastening these stacked key support sections to said base section by screws that are vertically inserted from the top, and screw heads of said screws contact only against the key support section of said black key unit.

13. An electronic musical keyboard apparatus comprising: a base section; key stems; key support sections; and connection sections to enable each key stem to swing vertically in a key depression direction about a respective key support section; wherein said connection section has an overall transverse width that is wider than a width of back-ends of key stems to be joined to said connection sections, and a portion of a connection section of a key stem vertically overlaps a connection section of an adjacent key stem; said keyboard apparatus comprised by white keys arranged in a first white key unit and in a second white key unit, each key unit having white key stems, connection sections and key support sections, and black keys arranged in a black key unit having black key stems, connection sections and key support sections; so that said first white key unit, said second white key unit and said black key unit are assembled by stacking respective key support sections of each key unit vertically fastened to said base section by screws, and screw heads of said screws contact only against key support sections of said black key units;

and said key support sections and connection sections in black key units are positioned at a topmost layer of an assembled keyboard apparatus.

* * * * *